United States Patent [19]

Clearman et al.

[11] Patent Number: 5,019,122

[45] Date of Patent: May 28, 1991

[54] SMOKING ARTICLE WITH AN ENCLOSED HEAT CONDUCTIVE CAPSULE CONTAINING AN AEROSOL FORMING SUBSTANCE

[75] Inventors: Jack F. Clearman, Blakely, Ga.; William J. Casey; Olivia P. Furin, both of Clemmons, N.C.; Grant M. Stewart, Winston-Salem, N.C.

[73] Assignee: R. J. Reynolds Tobacco Company, Winston-Salem, N.C.

[21] Appl. No.: 88,170

[22] Filed: Aug. 21, 1987

[51] Int. Cl.[5] ..... A24D 1/00; A24D 1/18

[52] U.S. Cl. ..... 131/194; 131/335; 131/337

[58] Field of Search ..... 131/194, 195, 335, 368, 131/359

[56] References Cited

U.S. PATENT DOCUMENTS

| | | | |
|---|---|---|---|
| 2,907,686 | 10/1959 | Siegel | 131/359 |
| 3,258,015 | 6/1966 | Ellis et al. . | |
| 3,339,557 | 12/1967 | Karalus . | |
| 3,356,094 | 12/1967 | Ellis et al. . | |
| 3,366,121 | 12/1967 | Carty . | |
| 3,390,686 | 2/1968 | Irby et al. . | |
| 3,428,049 | 2/1969 | Leake et al. . | |
| 3,516,417 | 6/1970 | Moses . | |
| 3,596,665 | 8/1971 | Lingard . | |
| 3,916,914 | 1/1976 | Brooks et al. . | |
| 3,943,941 | 3/1976 | Boyd . | |
| 3,991,773 | 9/1976 | Walker . | |
| 4,044,777 | 8/1977 | Boyd et al. . | |
| 4,079,742 | 3/1979 | Rainer et al. . | |
| 4,284,089 | 6/1981 | Ray . | |
| 4,286,604 | 9/1981 | Ehretsmann et al. . | |
| 4,326,544 | 4/1982 | Hardwick et al. . | |
| 4,340,072 | 7/1982 | Bolt et al. . | |
| 4,391,285 | 7/1983 | Burnett et al. . | |
| 4,474,191 | 10/1984 | Steiner . | |

FOREIGN PATENT DOCUMENTS

| | | | |
|---|---|---|---|
| 117355 | 1/1985 | European Pat. Off. . | |
| 174645 | 3/1986 | European Pat. Off. . | |
| 212234 | 3/1987 | European Pat. Off. . | |
| 23237 | 6/1986 | Iran . | |
| 0188572 | 3/1964 | Sweden | 131/337 |

*Primary Examiner*—V. Millin

*Attorney, Agent, or Firm*—Grover M. Myers; David G. Conlin

[57] ABSTRACT

A heat conductive capsule which carries or contains an aerosol forming material for use in smoking articles which upon heating ruptures or otherwise undergoes a change in structure to release at least a portion of the aerosol forming material, which aerosol resembles tobacco smoke, but preferably contains no more than a minimal amount of incomplete combustion or pyrolysis products.

The preferred smoking article of the present invention provides an aerosol "smoke" which is chemically simple, consisting essentially of air, oxides of carbon, water, and the aerosol which carries any desired flavor or other desired volatile materials, and trace amounts of other materials.

One especially preferred embodiment of the present smoking article comprises a short combustible carbonaceous fuel element, encapsulated aerosol forming substance, and a relatively long mouthend piece. The capsule is preferably formed from a heat conductive metal such as aluminum foil.

15 Claims, 2 Drawing Sheets

SMOKING ARTICLE WITH AN ENCLOSED HEAT CONDUCTIVE CAPSULE CONTAINING AN AEROSOL FORMING SUBSTANCE

BACKGROUND OF THE INVENTION

The present invention relates to smoking articles incorporating a heat conductive capsule which undergoes a change in structure during use to release aerosol forming material contained therein, which aerosol preferably resembles tobacco smoke.

Cigarette-like smoking articles have been proposed for many years, especially during the last 20 to 30 years. See for example, U.S. Pat. No., 4,079,742 to Rainer et al; U.S. Pat. No. 4,284,089 to Ray; U.S. Pat. No. 2,907,686 to Siegel; U.S. Pat. Nos. 3,258,015 and 3,356,094 to Ellis et al.; U.S. Pat. No. 3,516,417 to Moses; U.S. Pat. Nos. 3,943,941 and 4,044,777 to Boyd et al.; U.S. Pat. No. 4,286,604 to Ehretsmann et al.; U.S. Pat. No. 4,326,544 to Hardwick et al.; U.S. Pat. No. 4,340,072 to Bolt et al.; U.S. Pat. No. 4,391,285 to Burnett; U.S. Pat. No. 4,474,191 to Steiner; and European Patent Appln. No. 117,355 (Hearn).

As far as the present inventors are aware, none of the foregoing smoking articles or tobacco substitutes have ever realized any commercial success and none have ever been widely marketed. The absence of such smoking articles from the marketplace is believed to be due to a variety of reasons, including insufficient aerosol generation, both initially and over the life of the product, poor taste, off-taste due to thermal degradation of the smoke former and/or flavor agents, the presence of substantial pyrolysis products and sidestream smoke, and unsightly appearance.

Thus, despite decades of interest and effort, there is still no smoking article on the market which provides the benefits and advantages associated with conventional cigarette smoking, without delivering considerable quantities of incomplete combustion and pyrolysis products.

In 1985, a series of foreign patents were granted or registered disclosing novel smoking articles capable of providing the benefits and advantages associated with conventional cigarette smoking, without delivering appreciable quantities of incomplete combustion or pyrolysis products. The earliest of these patents was Liberian Patent No. 13985/3890, issued 13 Sept. 1985. This patent corresponds to a later published European Patent Application, Publication No. 174,645, published 19 Mar. 1986.

SUMMARY OF THE INVENTION

The present invention is directed to smoking articles which include a heat source, such as a combustible fuel element, and a heat conductive capsule which encloses or encapsulates an aerosol forming material. The heat conductive capsule is designed and located, preferably in a conductive heat exchange relationship to the fuel, so that, upon lighting, the aerosol forming material in the capsule quickly expands and ruptures the capsule, or the structure of the capsule is otherwise changed, to release the aerosol forming material so that it may form an aerosol which preferably resembles tobacco smoke. Preferably, the capsule is made from a material, such as aluminum foil or thin aluminum tubing, and is configured and located so that the capsule preferably ruptures or the structure is otherwise changed within seconds after the heat source is ignited.

Preferably a sorbent or blotting material is provided adjacent or abutting the capsule to absorb, adsorb, or otherwise temporarily retain the aerosol forming material released from the capsule. The sorbent or blotting material does not prevent vaporization of the material or the production of the aerosol from the aerosol forming material. It merely helps provide more uniform aerosol delivery over the life of the product.

Alternatively, the blotting material may be placed within the capsule itself to contain at least a portion of the aerosol forming substances within the capsule even after rupture of the capsule. Upon heating, the blotting material can preferably expand with the aerosol forming substance to help cause the capsule to rupture and thus permit volatilization of the aerosol forming substances released therefrom. In addition, the blotting material helps to retain the aerosol forming material which permits desired amounts of aerosol to be delivered over the life of the article.

Smoking articles which employ the heat conductive capsule of the invention are capable of producing substantial quantities of aerosol, both initially and over the useful life of the product, without significant thermal degradation of the aerosol former and without the presence of substantial pyrolysis or incomplete combustion products or sidestream smoke. Thus preferred smoking articles can provide the user with the sensations and benefits of cigarette smoking without burning tobacco.

It is believed that encapsulation of aerosol forming substance in accordance with the present invention greatly reduces or eliminates moisture pickup, which increases the heat load on the fuel, and reduces or eliminates migration of the aerosol forming substance to other parts of the smoking article, e.g., the fuel element. Other advantages include reduction of total mass of the smoking article, since it is not necessary to include a substrate or carrier for the aerosol forming substance, which in turn, results in an overall reduction in the amount of heat required to generate an aerosol. A reduction in heat results in a cooler aerosol being delivered to the user, a decrease in the carbon monoxide produced and less thermal decomposition of the aerosol forming materials. Further advantages include high conductivity of heat to the encapsulated materials and early and sustained delivery of aerosol over the life of the smoking article.

In preferred embodiment of the invention, the smoking article has a short, carbonaceous fuel element, preferably less than about 10–15 mm in length and the fuel element is coupled to the capsule by a heat conducting member, such as a metal foil or tube which efficiently conducts or transfers heat from the burning fuel element to the capsule. In some preferred embodiments, the heat conductive capsule itself can be used to form this heat conducting member.

In other embodiments, the heat exchange relationship can be essentially convective in nature, whereby upon lighting of the fuel element combustion products or other heated gaseous material can be used to provide convective heat to the capsule to cause release of the aerosol forming material into the mainstream.

Preferred embodiments of this invention are capable of delivering at least 0.6 mg of aerosol, measured as wet total particulate matter (WTPM), in the first 3 puffs, when smoked under FTC smoking conditions, which consist of 35 ml puffs of two seconds duration, separated by 58 seconds of smolder. More preferably, embodiments of the invention are capable of delivering 1.5 mg or more of aerosol in the first 3 puffs. Most preferably, embodiments of the invention are capable of delivering 3 mg or more of aerosol in the first 3 puffs when smoked under FTC smoking conditions. Moreover, preferred embodiments of the invention deliver an average of at least about 0.8 mg of WTPM per puff for at least about 6 puffs, preferably at least about 10 puffs, under FTC smoking conditions.

In addition to the aforementioned benefits, preferred smoking articles of the present invention are capable of providing an aerosol which is chemically simple, consisting essentially of air, oxides of carbon, water, the aerosol former, any desired flavors or other desired volatile materials, and trace amounts of other materials. The aerosol preferably also has no significant mutagenic activity as measured by the Ames Test. In addition, preferred articles may be made virtually ashless, so that the user does not have to remove any ash during use.

As used herein, and only for the purposes of this application, "aerosol" is defined to include vapors, gases, particles, and the like, both visible and invisible, and especially those components perceived by the user to be "smoke-like", generated by action of the heat from the burning fuel element upon substances contained within the capsule, or elsewhere in the article. As so defined, the term "aerosol" also includes volatile or sublimeable flavoring agents and/or pharmacologically or physiologically active agents, irrespective of whether they produce a visible aerosol.

As used herein, the term "blotting material" means those materials which absorb, adsorb, retain or contain, e.g. by surface tension, capillary action, and the like, aerosol forming materials, flavorants as well as other materials used to generate aerosol in smoking articles.

The smoking article of the present invention is described in greater detail in the accompanying drawings and in the detailed description of the invention which follows.

DETAILED DESCRIPTION OF THE PREFERRED EMBODIMENTS

Preferred cigarette-type smoking articles which may employ the heat conductive capsule of the present invention are described in the following patent applications:

| Applicants | Serial No. | Filed |
|---|---|---|
| Sensabaugh et al. | 650,604 | September 14, 1984 |
| Shannon et al. | 684,537 | December 21, 1984 |
| Banerjee et al. | 939,203 | December 8, 1986 |
| Sensabaugh et al. | EPO 85111467.8 | September 11, 1985 |

-continued

| Applicants | Serial No. | Filed |
|---|---|---|
| Banerjee et al. | EPO 86109589.1 | (published 3/19/86) September 14, 1985 (published 3/4/87) |

the disclosures of which are hereby incorporated by reference.

Use of preferred embodiments of the present invention in such smoking articles normally results in: (a) a reduction of moisture pickup by the aerosol forming substance; (b) a reduction in migration of aerosol forming substances to the fuel during storage; (c) minimum mass of the article due to the absence of a substrate for the aerosol forming substances; (d) early delivery of the aerosol forming substance or substances; (e) absence or control of pressure drop in the capsule due to contents thereof; (f) reduction in loss of aerosol former and/or flavorants, since the aerosol former and/or flavorants are sealed in the capsule until use.

Figure 1:
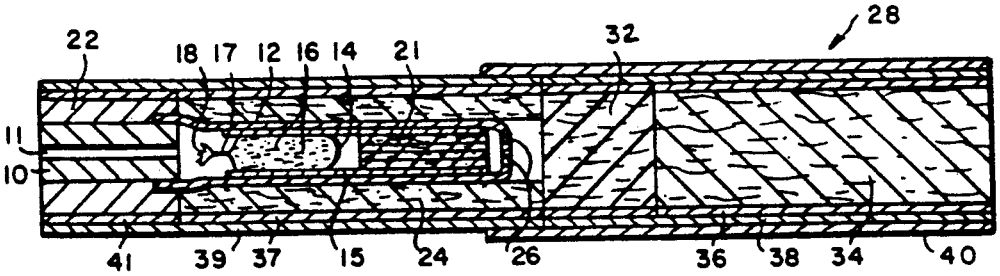
FIGS. 1 through 5 are longitudinal sectional views of various embodiments of the invention.
Figure 1A:
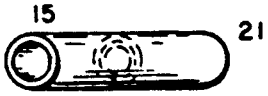
FIG. 1A is a perspective view of a preferred embodiment of a tobacco structure used in certain preferred embodiments.

One preferred cigarette-type smoking article employing the present invention is shown in FIG. 1. Referring to FIG. 1 there is illustrated a cigarette-type smoking article having a small carbonaceous fuel element 10 with several passageways 11 therethrough, preferably about thirteen arranged as shown in FIG. 1A. This fuel element is formed from an extruded mixture of carbon (preferably from carbonized paper), sodium carboxymethyl cellulose (SCMC) binder, $K_2CO_3$, and water, as described in the above referenced patent applications.

Overlapping the mouthend of the fuel element 10 is a metallic container 12, which is preferably about 4.5 mm in diameter and about 30 mm in length. Inside container 12 is a heat conductive aluminum foil capsule 14 which contains an aerosol forming substance and/or flavoring agents 16. Capsule 14 is closed at neck 17 by a pinch in the foil to seal the aerosol forming material inside and to form a baffle 18. This embodiment also includes a blotting material 21 such as an air laid sheet or other form of tobacco which preferably forms a sleeve 15 around capsule 14 and also fills the void at the mouthend of heat conductive member 12. FIG. 1A shows the shape of the air laid tobacco used as the blotting material. The sheet is preferably rolled to provide sleeve 15 into which capsule 14 is inserted and further rolled to form the plug 21 of blotting material which absorbs the bulk of the aerosol former as it is released from capsule 14.

The periphery of fuel element 10 in this article is surrounded by a jacket 22 of resilient insulating fibers, such as glass fibers. Preferably container 12 is surrounded by a jacket of tobacco 24. The rear portion of container 12 is sealed, except for two openings or slits 26 for the passage of the aerosol forming materials to the user.

At the mouthend of tobacco jacket 24 is situated a mouthend piece 28 comprising a short (10 mm) segment of folded or gathered sheet tobacco 32 and a longer (30 mm) segment of folded or gathered, meltblown thermoplastic polypropylene fiber 34, which, in combination, provide a flow path for the aerosol. As illustrated, the article (or portions thereof) is overwrapped with one or more layers of cigarette papers 36–42.

During use, heat generated by the fuel element reaches the baffle which quickly causes the aerosol forming material in the capsule 14 to expand, which opens the pinched seal 17, releasing the aerosol forming material, most of which is initially absorbed by blotting material 21.

Figure 2:
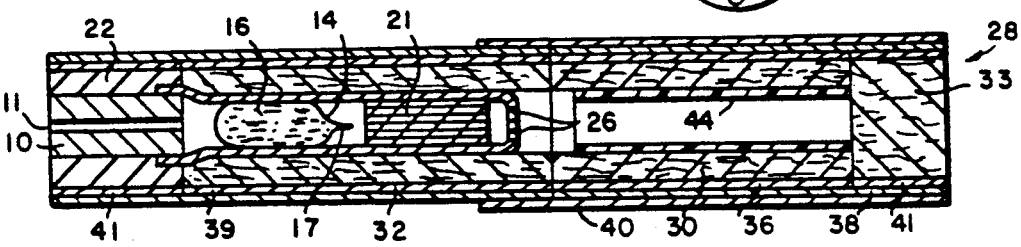

The embodiment illustrated in FIG. 2 is similar to that of FIG. 1, except that capsule 14 is prepared from aluminum tubing which is crimped or sealed at the fuel end to prevent release of the aerosol during smoking and pinched at the mouthend 17 so as to encapsulate the aerosol forming materials. Heat generated by the fuel element results in expansion of the aerosol former which ruptures the capsule at its pinch mouthend 17. The mouthend piece 28 of this embodiment consists of a cellulose acetate tube 30 surrounding an optional plastic, e.g., polypropylene or MYLAR tube 44. At the mouthend of this embodiment, there is a low efficiency cellulose acetate filter 33. The entire length of the article is wrapped with one or more layers of conventional cigarette paper 36–41.

Figure 3:
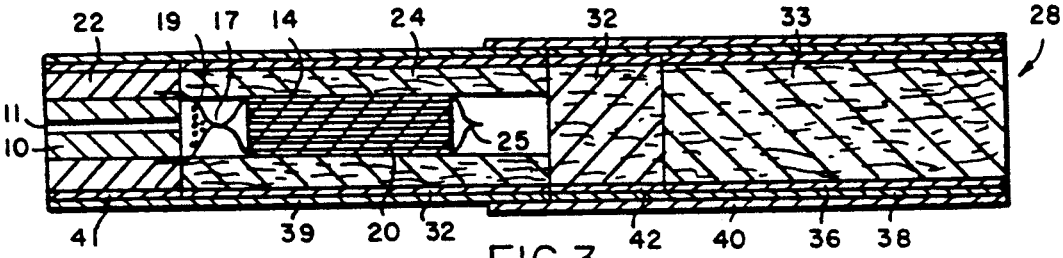

The embodiment illustrated in FIG. 3 is similar to that of FIG. 1 except that capsule 14 also serves as a heat conductive member in contact with the fuel element. Capsule 14 is formed from a piece of aluminum tubing which is pinched to form a seal 25 at the mouthend. The fuel end of capsule 14 surrounds the rear portion of the fuel element 10 and is pinched to form a seal at neck 17. A plurality of holes 19 are provided between neck 17 and fuel element 10 to facilitate passage of hot gases from the fuel element to the aerosol generating means. As illustrated, blotting material 20 is located within capsule 14 along with the aerosol forming substance or substances which are substantially absorbed or adsorbed by the blotting material. Upon smoking, the capsule ruptures at seals 17 and 25, releasing the aerosol former into the area surrounding the capsule. In this embodiment, tobacco jacket 24 may also serve as a blotting material.

Figure 4:
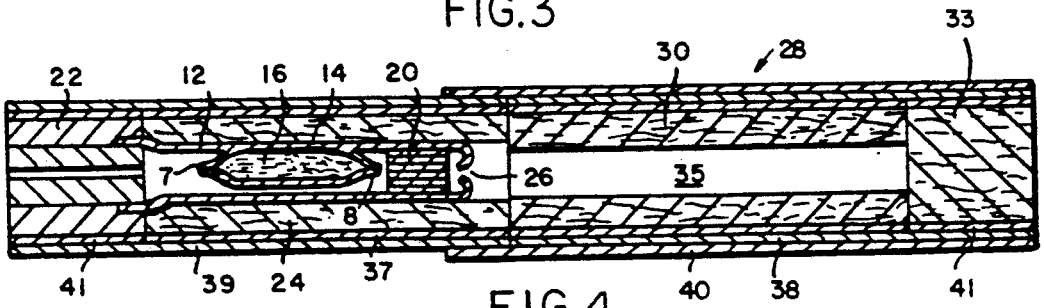
Figure 4A:
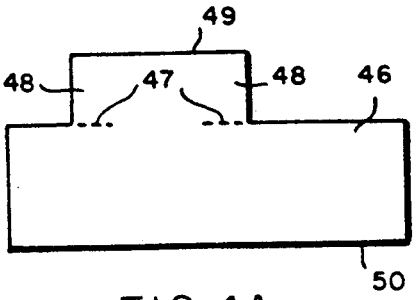
FIG. 4A is a plan view of a piece of metal foil to be used to construct a heat conductive capsule.

The embodiment shown in FIG. 4 is similar to that of FIG. 2. In FIG. 4, the heat conductive member 12 and capsule 14 are formed from one piece of foil. As shown, heat conductive member 12 overlaps the mouthend of fuel element 10. FIG. 4A shows the shape of the foil used to make the heat conductive/capsule combination of this embodiment. Foil 46 is cut along the dotted lines 47 to form flaps 48. Foil 46 is then rolled from edge 49 to edge 50 to form an outer tube and an inner tube. The outer tube corresponds to heat conductive member 12 while the inner tube corresponds to capsule 14 which is formed by pinching flaps 48. The mouthend 26 of heat conductive member 12 is crimped to enclose the inner tube which is either pinched or crimped at both ends 7, 8 and contains aerosol forming material 16 and to enclose blotting material 20. Longitudinal passageway 35 is provided in the mouthend piece to permit the passage of the aerosol forming substance to the user. During smoking the aerosol within the inner tube migrates between the various layers of the aluminum foil and is subsequently released into the mainstream of the article. If the ends 7 and 8 are pinched, release of aerosol may also be effected by the eventual rupturing of the pinched ends.

Figure 5:
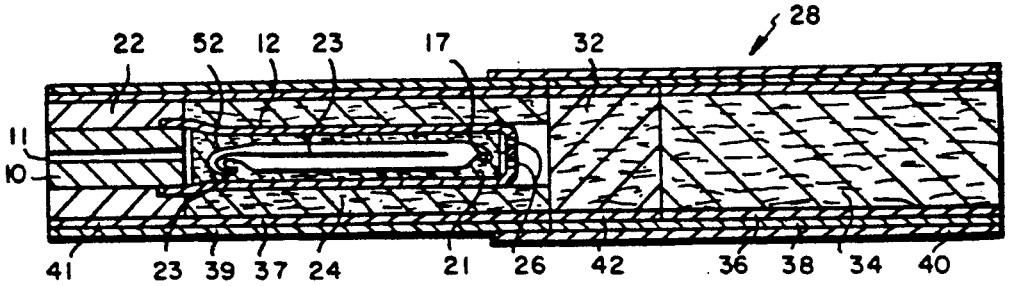

The embodiment illustrated in FIG. 5 is similar to that of FIG. 1, except that capsule 14, prepared from aluminum tubing or foil, is crimped or sealed at the mouthend 17 to prevent release of the aerosol during smoking. The fuel end of capsule 14 is formed into a narrow neck-shaped configuration into or around which there is a thread-like wicking material 23 which extends from inside capsule 14 through neck 52. Heat generated by the fuel element results in expansion of the aerosol former which through a wicking action is released into the blotting material 21 which surrounds capsule 14.

Because the preferred fuel element is relatively short, the hot, burning fire cone is always close to the aerosol generating means which maximizes heat transfer to the capsule, and resultant production of aerosol, especially when the preferred heat conducting member is used.

Because of the small size and burning characteristics of the fuel element, the fuel element usually begins to burn over most of its exposed length within a few puffs. Thus, that portion of the fuel element adjacent to the aerosol generator becomes hot quickly, which significantly increases heat transfer to the aerosol generator, especially during the early puffs. Because the preferred fuel element is so short prior to lighting and throughout its burning, there is never a long section of nonburning fuel to act as heat sink, as was common in previous thermal aerosol articles.

Because the aerosol forming substance is physically separate from the fuel element, the aerosol forming substance is exposed to substantially lower temperatures than are generated by the burning fuel, thereby minimizing the possibility of its thermal degradation. This also results in aerosol production almost exclusively during puffing, with little or no aerosol production from the aerosol generating means during smolder.

The heat conductive capsule of the present invention may be constructed from a variety of materials including aluminum foil or tubing, ceramic, or other such materials which will quickly absorb heat and rupture or otherwise change structure to release the aerosol forming substance carried or contained therein. Conductive foil such as aluminum foil or tubing in the form of a pinched or sealed capsule is preferred. The thickness of the material used to form the capsule may range between about 0.00025" and 0.002", preferably between about 0.0003" and 0.0015", and most preferably between about 0.00037" and 0.001". Aluminum foil useful in practicing the present invention is commercially available from Reynolds Aluminum. Aluminum tubing is available from Niemand. In general, the conductivity of such materials in g-cal/(sec)(cm$^2$)/(°C./cm) may range between 0.001 and 0.6. Preferably the conductivity is greater than about 0.3. Most preferably the conductivity is greater than about 0.5. The material employed should also be relatively impermeable to, for example, the aerosol forming material(s). In general, it should be more than about 90% impermeable to such materials. Preferably, more than about 97% impermeable. Most preferably, more than about 99% impermeable. Preferred materials employed as the heat conductive and heat releasable capsule should be heat stable up to about 200° C.

Other materials which may be used in conjunction with the heat conductive capsule in accordance with the present invention include conductive pellets or particles, e.g., alumina pellets, conductive strands, conductive, webs, meshes, and other forms. When such materials are used, the aerosol forming material may be simply applied to the heat absorbing material, and later released from the capsule by heat generated by the fuel element.

The aerosol generating means which includes the heat conductive capsule of the present invention is preferably spaced no more than 15 mm from the lighting end of the fuel element. The aerosol generating means may vary in length from about 2 mm to about 60 mm, preferably from about 5 mm to 40 mm, and most preferably from about 20 mm to 35 mm. The diameter of the aerosol generating means may vary from about 2 mm to about 8 mm, preferably from about 3 to 6 mm.

The heat conductive capsule used in the invention is usually spaced no more than about 15 mm, preferably no more than 5 mm from the mouth end of the fuel element. The preferred heat conductive and heat releasable capsule is usually between about 5 to about 40 mm in length. The preferred length is between about 10 to 30 mm, most preferably about 15 mm. The diameter of the capsule is generally the same or less than that of the fuel element.

In certain embodiments it may be desirable to employ more than one heat conductive capsule, either separate capsules or capsules linked to each other by, for example, pinching aluminum tubing or foil at one or more junctions to form distinct capsules. Each capsule may contain the same aerosol former which is released over the life of the article or each capsule could contain different materials such as an aerosol former and flavorant.

The aerosol forming substance or substances used in the preferred smoking articles must be capable of forming an aerosol at the temperatures present in the aerosol generating means upon heating by the burning fuel element. The preferred aerosol forming substances are polyhydric alcohols, or mixtures of polyhydric alcohols. More preferred aerosol formers are selected from glycerin, triethylene glycol and propylene glycol.

The heat conductive capsules containing the aerosol forming substance may include one or more volatile flavoring agents, such as menthol, vanillin, artificial coffee, tobacco extracts, nicotine, caffeine, liquors, and other agents which impart flavor to the aerosol. It also may include any other desirable volatile solid or liquid materials. Alternatively, or additionally, these optional agents may be placed between the aerosol generator and the mouthend, such as in the blotting material, in a separate particulate or nonparticulate substrate in the passage which connects the aerosol generator to the mouthend of the article, or in an optional tobacco charge. If desired, such volatile agents may be used in lieu of part or all of the aerosol forming substance, so that the article delivers a flavor or other material to the user.

Blotting materials useful in preferred smoking articles may virtually be any material which will absorb the aerosol forming material as it is released from the ruptured capsule and thereafter release it in order to provide good aerosol delivery over the life of the article. Such materials include puffed tobacco, an air laid sheet of tobacco, reconstituted tobacco sheet, alumina, deactivated carbon, paper, e.g. blotting paper, and the like. The blotting material should absorb, adsorb, or otherwise retain aerosol forming material(s) sufficiently that it does not run or migrate out of the smoking device. The blotting material should not bind so tenaciously as to interfere with the generation of the desired aerosol.

A preferred blotting material is an air laid sheet of tobacco obtained from Kimberly-Clark, designated P-1166-12-4, which is rolled to about a diameter less than or equal to the diameter of the heat conductive member and placed in the aerosol generating means adjacent or abutting the capsule. It has been found that the use of an air laid sheet of tobacco as the blotting material is particularly advantageous as it minimizes the pressure drop between the aerosol generating means and mouthend of the smoking article and also adds tobacco flavor to the aerosol produced upon smoking. The air laid sheet of tobacco is generally cut into squares, the dimensions thereof varying depending both on the length of the capsule and heat conductive member. Thus, the length of the rolled sheet of tobacco may range between about 5 mm and 40 mm, preferably between about 10 mm and 20 mm, most preferably about 10 mm. In one preferred embodiment, the air laid sheet of tobacco is cut so as to include a sleeve which surrounds the heat conductive and heat releasable capsule as illustrated in FIGS. 1 and 1A.

Articles of the type disclosed herein may be used or may be modified for use as drug delivery articles, for delivery of volatile pharmacologically or physiologically active materials such as ephedrine, metaproterenol, terbutaline or the like.

While not preferred, embodiments employing the heat conductive and heat releasable capsule of the present invention may also include a separate thermally stable substrate or carrier material which carries one or more of the aerosol forming substances. As used herein, a thermally stable material is one capable of withstanding the high temperatures, e.g., 400° C.-600° C., which exist near the fuel without the decomposition or burning. The use of such material is believed to help maintain the simple "smoke" chemistry of the aerosol, as evidenced by the lack of Ames Test activity.

Useful thermally stable materials include thermally stable absorbent carbons, such as electrode grade carbons, graphite, activated, or non-activated carbons, and the like in suitable form. Other suitable materials include inorganic solids such as ceramics, alumina, vermiculite, clays such as bentonite, and the like. The currently preferred substrate materials are activated carbons and alumina.

Advantageous substrates or blotting materials may also be formed from carbon, tobacco or mixtures thereof, into composite particles using a machine made by Fuji Paudal KK (formerly Fuji Denki Kogyo KK) of Japan, and sold by the Luwa Corporation of Charlotte, N.C. under the trade name of "Marumerizer." This apparatus is described in U.S. Pat. No. 3,277,520. Nonparticulate substrates can be formed from such treated materials by conventional pressing, extrusion, cutting, shaping and similar techniques.

The aerosol forming substance may be dispersed on or within the substrate material in a concentration sufficient to permeate or coat the material, by any known technique. The substrate may then be used to load the heat conductive capsule.

In general, the combustible fuel elements which may be employed in preferred embodiments have a diameter no larger than that of a conventional cigarette (i.e., less than or equal to 8 mm), and are generally less than about 30 mm long. Advantageously the fuel element is about 15 mm or less in length, preferably about 10 mm or less in length. Advantageously, the diameter of the fuel element is between about 2 to 8 mm, preferably about 4 to 6 mm. The density of the fuel elements employed herein may range from about 0.7 g/cc to about 1.5 g/cc. Preferably the density is greater than about 0.85 g/cc.

The preferred material used for the formation of fuel elements is carbon. Preferably, the carbon content of these fuel elements is at least 60 to 70%, most preferably about 80% or more, by weight. High carbon content fuel elements are preferred because they produce minimal pyrolysis and incomplete combustion products, little or no visible sidestream smoke, and minimal ash, and have high heat capacity. However, lower carbon content fuel elements e.g., about 50 to 60% by weight may be used especially where a minor amount of tobacco, tobacco extract, or a nonburning inert filler is used. Preferred fuel elements are described in greater detail in the above referenced patent applications.

The heat conducting member employed as the container for the capsule and aerosol forming material is typically a metallic foil, such as aluminum foil, varying in thickness from less than about 0.01 mm to about 0.1 mm, or more. The thickness and/or the type of conducting material may be varied (e.g., Grafoil, from Union Carbide) to achieve virtually any desired degree of heat transfer.

The insulating members employed in the preferred smoking articles are preferably formed into a resilient jacket from one or more layers of an insulating material. Advantageously, this jacket is at least about 0.5 mm thick, preferably at least about 1 mm thick. Preferably, the jacket extends over more than about half, if not all of the length of the fuel element. More preferably, it also extends over substantially the entire outer periphery of the fuel element and the capsule for the aerosol generating means. As shown in the embodiment of FIGS. 1-4, different materials may be used to insulate these two components of the article.

The currently preferred insulating materials, paticularly for the fuel element, are ceramic fibers, such as glass fibers. Preferred glass fiber are experimental materials produced by Owens - Corning of Toledo, Ohio under the designations 6432 and 6437, which have softening points of about 650° C. Other suitable insulating materials, preferably non-combustible inorganic materials, may also be used.

In the most preferred embodiments, the fuel and aerosol generating means will be attached to a mouthend piece, although a mouthend piece may be provided separately, e.g., in the form of a cigarette holder for use with disposable fuel/aerosol generating cartridges. The mouth end piece channels the vaporized aerosol forming substance into the mouth of the user. Due to its length, about 35 to 50 mm, it also keeps the heat from the fire cone away from the mouth and fingers of the user, and provides some cooling of the hot aerosol before it reaches the user.

Suitable mouthend pieces should be inert with respect to the aerosol forming substances, should offer minimum aerosol loss by condensation or filtration, and should be capable of withstanding the temperature at the interface with the other elements of the article. Preferred mouthend pieces include the tobacco sheet — polypropylene fiber combination of FIG. 1 and the mouthend pieces disclosed in the above referenced European Patent Publication Nos. 174,645 and 212,234.

To maximize aerosol delivery, which otherwise could be diluted by radial (i.e., outside) air infiltration through the article, a non-porous paper may be used from the aerosol generating means to the mouth end.

Papers such as these are known in the cigarette and/or paper arts and mixtures of such papers may be employed for various functional effects. Preferred papers used in the articles of the present invention include RJR Archer's 8-0560-36 Tipping with Lip Release paper, Ecusta's 646 Plug Wrap and ECUSTA 30637-801-12001 manufactured by Ecusta of Pisgah Forest, N.C., and Kimberly-Clark's papers P850-186-2, P1487-184-2 and P1487-125.

The aerosol produced by the preferred articles of the present invention is chemically simple, consisting essentially of air, oxides of carbon, aerosol former including any desired flavors or other desired volatile materials, water and trace amounts of other materials. The WTPM produced by the preferred articles of this invention has no mutagenic activity as measured by the Ames test, i.e., there is no significant dose response relationship between the WTPM produced by preferred articles of the present invention and the number of revertants occurring in standard test microorganisms exposed to such products. According to the proponents of the Ames test, a significant dose dependent response indicates the presence of mutagenic materials in the products tested. See Ames et al., *Mut. Res.*, 31: 347-364 (1975); Nagao et al., *Mut. Res.*, 42: 335 (1977).

A further benefit from the preferred embodiments of the present invention is the relative lack of ash produced during use in comparison to ash from a conventional cigarette. As the preferred carbon fuel element is burned, it is essentially converted to oxides of carbon, with relatively little ash generation, and thus there is no need to dispose of ashes while using the article.

The use of the heat conductive capsule of the present invention in the construction of cigarette-like smoking articles will be further illustrated with reference to the following examples which will aid in the understanding of the present invention, but which is not to be construed as a limitation thereof. All percentages reported herein, unless otherwise specified, are percent by weight. All temperatures are expressed in degrees Celsius and are uncorrected.

EXAMPLE I

A smoking article of the type illustrated in FIG. 1 was made in the following manner.

A. Fuel Source Preparation

The fuel element (10 mm long, 4.5 mm o.d.) having an apparent (bulk) density of about 0.86 g/cc, was prepared from carbon (90 wt. percent), SCMC binder (10 wt. percent) and $K_2CO_3$ (1 wt. percent).

The carbon was prepared by carbonizing a non-talc containing grade of Grand Prairie Canadian Kraft hardwood paper under a nitrogen blanket, at a step-wise increasing temperature rate of about 10° C. per hour to a final carbonizing temperature of 750° C.

After cooling under nitrogen to less than about 35° C., the carbon was ground to a mesh size of minus 200. The powdered carbon was then heated to a temperature of up to about 850° C. to remove volatiles.

After cooling under nitrogen to less than about 35° C., the carbon was ground to a fine powder, i.e., a powder having an average particle size of from about 0.1 to 50 microns.

This fine powder was admixed with Hercules 7HF SCMC binder (9 parts carbon : 1 part binder), 1 wt. percent $K_2CO_3$, and sufficient water to make a stiff, dough-like paste.

Figure 1B:
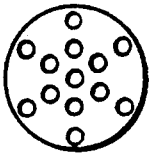
FIG. 1B illustrates, from the lighting end, a preferred fuel element passageway configuration.

Fuel elements were extruded from this paste having seven central holes each about 0.021 in. in diameter and six peripheral holes each about 0.01 in. in diameter. The web thickness or spacing between the central holes was about 0.008 in. and the average outer web thickness (the spacing between the periphery and the peripheral holes) was 0.019 in. as shown in FIG. 1B.

These fuel elements were then baked-out under a nitrogen atmosphere at 900° C. for three hours after formation.

B. Spray Dried Extract

A blend of flue cured tobaccos were ground to a medium dust and extracted with water in a stainless steel tank at a concentration of from about 1 to 1.5 pounds tobacco per gallon of water. The extraction was conducted at ambient temperature using mechanical agitation for from about 1 hour to about 3 hours. The admixture was centrifuged to remove suspended solids and the aqueous extract was spray dried by continuously pumping the aqueous solution to a conventional spray dryer, such as an Anhydro Size No. 1, at an inlet temperature of from about 215°-230° C. and collecting the dried powder material at the outlet of the drier. The outlet temperature varied from about 82°-90° C.

C. Encapsulation of Aerosol Forming Material

A capsule of the type shown in FIG. 1 was prepared from aluminum foil having a thickness of about 0.000375" as follows: a 19 mm diameter circular piece of the foil was shaped around a metal rod to form a capsule of about 3.8 mm in diameter and 8 mm in length. Approximately 40 ml of an aerosol forming material was dispensed into the capsule which was sealed by pinching to form a closed capsule of approximately 5 mm in length. The aerosol forming material comprised an initial mixture of 9 parts glycerin to 1 part spray dried extract. This mix was then combined with about a 10 weight percent coffee flavorant.

D. Assembly

The heat conductive member comprised a metallic container of 30 mm long spirally wound aluminum tubes obtained from Niemand, Inc., having a diameter of about 4.5 mm. Alternatively, a deep drawn capsule prepared from aluminum tubing about 4 mil thick (0.1016 mm), about 30 mm in length, having an outer diameter of about 4.5 mm may be used. One end of the tube was crimp to seal the mouthend of the tube. The sealed end of the tube was provided with two slot-like openings (each about 0.65×3.45 mm, spaced about 1.14 mm apart) to allow passage of the aerosol former to the user. A blotting material comprising an air laid sheet of tobacco (Kimberly Clark P1166-12-4, approximately 25 mm×25 mm) was rolled into a cylinder and inserted into the tube. The capsule containing the aerosol former and flavorant was thereafter inserted into the tube. After the capsule was inserted, the tube was joined to a fuel element by inserting about 2 mm of the fuel element into the open end of the tube.

E. Insulating Jacket

The fuel element — heat conductive member combination was overwrapped at the fuel element end with a 10 mm long, glass fiber jacket of Owens-Corning 6437 (having a softening point of about 650° C.), with 4 wt. percent pectin binder, to a diameter of about 7.5 mm, and overwrapped with Ecusta 646 plug wrap.

F. Tobacco Jacket

A 7.5 mm diameter tobacco rod (28 mm long) with a 646 plug wrap overwrap (e.g., from a non-filter cigarette) was modified with a probe to have a longitudinal passageway (about 4.5 mm diameter) therein.

G. Assembly

The jacketed fuel element — heat conductive member combination was inserted into the tobacco rod passageway until the glass fiber jacket abutted the tobacco. The glass fiber and tobacco sections were overwrapped with Kimberly-Clark's P878-16-2.

A cellulose acetate mouthend piece (30 mm long) overwrapped with Ecusta 646 plug wrap, of the type illustrated in FIG. 2, was joined to a filter element (10 mm long) having an overwrap of Ecusta 646 plug wrap by Kimberly Clark's P878-16-12 paper. This mouthend piece was joined to the jacketed fuel element — capsule by tipping paper.

Alternatively, a mouthend piece of the type illustrated in FIG. 1, may be constructed by combining two 7.5 mm in diameter sections: (1) a 10 mm section of a gathered or folded tobacco sheet material, such as P144-185GAPF from Kimberly-Clark, overwrapped with 646 plug wrap; and (2) a section of gathered or folded meltblown thermoplastic polypropylene fibers, preferably P-100-F, from Kimberly Clark, 30 mm long, overwrapped with Kimberly-Clark's P850-186-2 paper; with a combining overwrap of Kimberly-Clark's P850-186-2 paper.

The combined mouthend piece section was joined to the jacketed fuel element — capsule section by a final overwrap of RJR Archer Inc. 8-0560-36 tipping with lip release paper.

When compared with similar cigarette-type smoking articles, smoking articles prepared in accordance with the present invention produced an aerosol resembling tobacco smoke having good taste due to sealed in flavors and less off-taste due to pyrolysis of aerosol former since there is less migration of aerosol former to other portions of the smoking article, e.g. the fuel element.

EXAMPLE II

Smoking articles similar to those described in Example I were prepared. The heat conductive capsule was prepared from an aluminum tube having a thickness of about 0.0009" and a diameter of about 2.5 mm. The fuel end of the aluminum tubing was crimped to seal the tube and prevent migration or escape of the aerosol former upon lighting of the article. After loading with the aerosol former and flavorant, the mouthend of the tube was pinched. The heat generated by the burning fuel element caused expansion of the aerosol former within the aluminum tubing which, in turn, caused the capsule to rupture at the pinched end of the capsule. The release of the aerosol former and flavorant produced an aerosol resembling tobacco smoke without any apparent off-taste due to pyrolysis of the aerosol former.

EXAMPLE III

Figure 4B:
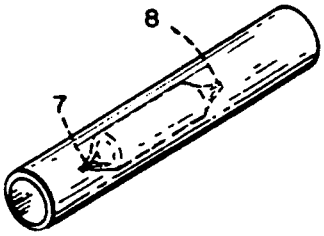
FIG. 4B is a perspective view of a metal foil heat conductive capsule/member made from the foil depicted in FIG. 4A.

Smoking articles of the type illustrated in FIG. 4 were prepared in a manner similar to the article described in Example I except that the capsule was prepared with aluminum foil having a thickness of about 0.002" as illustrated in FIG. 4A and rolled to have from 2 to 10 layers as illustrated in FIG. 4B. The fuel end of the capsule was crimped while the mouthend was pinched. Prior to crimping, the aerosol forming material was added dropwise to the inner tube portion of the foil. The blotting material was inserted into the mouthend section of the outer tube. Heat generated by the burning fuel caused release of the aerosol both from migration of the aerosol former around the various layers of the aluminum foil as well as from the subsequent rupturing of the capsule at the pinched end of the capsule.

What is claimed is:

1. A smoking article comprising:

(a) a fuel element; and (b) a heat conductive capsule located behind the fuel element which encloses an aerosol forming material and which, upon heating, undergoes a change in structure to release at least a portion of the aerosol forming material.

2. The article of claim 1, wherein the fuel element is carbonaceous.

3. The article of claim 1 or 2, wherein the heat conductive capsule comprises aluminum foil.

4. The article of claim 3, wherein the thickness of the aluminum foil is between about 0.00025" and 0.002".

5. The article of claim 1 or 2, further comprising a heat conductive member which is contiguous to both the heat source and the capsule and which conducts heat from the heat source to the capsule.

6. The article of claim 5, wherein the heat conductive capsule comprises the heat conductive member.

7. The article of claim 5, wherein the heat conductive capsule is a component part of said heat conductive member.

8. The article of claim 1 or 2, wherein the aerosol generating means further comprises a blotting material.

9. The article of claim 8, wherein the blotting material is adjacent the heat conductive capsule.

10. The article of claim 8, wherein the blotting material is contained within the heat conductive capsule.

11. The article of claim 8, wherein the blotting material is tobacco, alumina, non-activated carbon, or paper.

12. The article of claim 8, wherein the blotting material is air laid tobacco, reconstituted tobacco, puffed tobacco, or blotting paper.

13. The smoking article of claim 1, 2 or 3, wherein the heat conductive capsule is made of a material having a conductivity of greater than 0.3 g-cal/(sec)(cm$^2$)(°C./cm).

14. A smoking article comprising:

(a) a fuel element; and (b) a physically separate heat conductive capsule located behind the fuel element and sealed to enclose an aerosol forming material, which seal, upon heating, ruptures to release at least a portion of the aerosol forming material.

15. A smoking article comprising:

(a) a fuel element; and (b) a physically separate container containing a heat conductive capsule which encloses an aerosol forming material and which, upon heating, undergoes a change in structure to release at least a portion of the aerosol forming material.

* * * * *

UNITED STATES PATENT AND TRADEMARK OFFICE

CERTIFICATE OF CORRECTION

PATENT NO. : 5,019,122

DATED : May 28, 1991

INVENTOR(S) : Jack F. Clearman et al

It is certified that error appears in the above-identified patent and that said Letters Patent is hereby corrected as shown below:

Col. 14, line 12, "2" should be --14-- and "3" should be --15--.

Signed and Sealed this

Twentieth Day of October, 1992

*Attest:*

DOUGLAS B. COMER

*Attesting Officer*

*Acting Commissioner of Patents and Trademarks*